US006316178B2

(12) United States Patent
Yamashita

(10) Patent No.: US 6,316,178 B2
(45) Date of Patent: Nov. 13, 2001

(54) SILVER HALIDE EMULSION AND SILVER HALIDE COLOR PHOTOGRAPHIC LIGHT-SENSITIVE MATERIAL

(75) Inventor: Seiji Yamashita, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/725,871

(22) Filed: Nov. 30, 2000

(30) Foreign Application Priority Data

Nov. 30, 1999 (JP) ..... 11-340981

(51) Int. Cl.[7] ..... G03C 1/09; G03C 1/015; G03C 1/035

(52) U.S. Cl. ..... 430/603; 430/569; 430/605; 430/550

(58) Field of Search ..... 430/605, 603, 430/569, 550

(56) References Cited

U.S. PATENT DOCUMENTS

| | | | |
|---|---|---|---|
| 5,691,119 | 11/1997 | Mydlarz et al. | 430/605 |
| 5,756,278 | 5/1998 | Lok | 430/605 |
| 5,912,112 | 6/1999 | Lok et al. | 430/605 |
| 5,945,270 | 8/1999 | Lok et al. | 430/605 |
| 6,034,249 | 3/2000 | Lok et al. | 548/253 |

*Primary Examiner*—Richard L. Schilling
(74) *Attorney, Agent, or Firm*—Sughrue, Mion, Zinn, Macpeak & Seas, PLLC

(57) ABSTRACT

Disclosed is a silver halide emulsion comprising gold-sensitized silver halide grains having a silver chloride content of 95 mole % or more, wherein from 8% to 50% of the amount of gold existing on the part of the silver halide grains is in the state of metal gold. The silver halide emulsion is an emulsion having a high silver chloride content that has high sensitivity and low fogging, and reduced both high illumination intensity reciprocity law failure and regression of latent image in the initial stage after exposure.

15 Claims, No Drawings

SILVER HALIDE EMULSION AND SILVER HALIDE COLOR PHOTOGRAPHIC LIGHT-SENSITIVE MATERIAL

FIELD OF THE INVENTION

The present invention relates to a gold-sensitized silver halide emulsion having a high silver chloride content, and a light-sensitive material using the same. In particular, such a silver halide emulsion having a high silver chloride content is preferably used for a color photographic light-sensitive material having a reflective support.

BACKGROUND OF THE INVENTION

High-speed light-sensitive silver chloride emulsions have not been developed sufficiently, because the intrinsic absorption of the silver chloride emulsion is small, and adsorption of a spectral sensitizing dye onto the silver chloride grains is weak. Consequently, investigation into gold sensitization of a silver chloride emulsion has not been made thoroughly, even though gold sensitization has been applied to a silver bromide- or silver iodobromide-based emulsion, as a matter of course.

However, recently both the demand for high-speed light-sensitive material and the need for realization of more rapid development resulting from compatibility of finely grained silver halide and advances in high speed thereof, are growing. As a prior art relative to gold sensitization concerning the need for such as compatibility of finely grained silver chloride-based silver halide and advances in high speed thereof, there are, for example, JP-A-11-218870 ("JP-A" means unexamined published Japanese patent application), JP-A-11-217388, JP-A-9-118685, JP-A-9-15771, JP-A-9-5922, JP-A-3-151648, JP-A-4-335338, JP-A-6-347944, JP-A-8-62763, Japanese published searched patent publication No. 6-501789, and U.S. Pat. Nos. 5,756,278 and 5,912,112.

However, ionic conductance of the silver chloride-based silver halide emulsion is low, and therefore the supply of silver ions is slow in latent image formation upon exposure to light. Accordingly, the silver chloride-based silver halide emulsion has such an inefficiency that the latent image is considered to hardly grow. It is well known that this defect is particularly related to a property that the so-called high illumination intensity reciprocity law failure is easily caused. On the other hand, it is also well known that gold sensitization is an important technique to solve this problem, since gold sensitization is effective in reducing the minimum size of a latent image that can be developed. However, up to the present time, the effect has been insufficient for the silver chloride-based silver halide emulsion, since the high illumination intensity reciprocity law failure occurs when the kind and amount of a sulfur sensitizer and a gold sensitizer are increased or decreased (mostly, increased) to enhance the sensitivity for a middle illumination intensity exposure to light.

Further, it is also well known that a spectrally sensitized silver chloride-based silver halide emulsion causes a problem of the so-called latent image regression, which means that desensitization occurs, resulting from the latent image being destroyed for a short time after exposure. It is also known that this problem can be overcome by gold sensitization, whereby oxidation-resistance is improved. However, when the kind and amount of a sulfur sensitizer and a gold sensitizer were increased or decreased (mostly, increased) for advances in high speed, the latent image regression still became conspicuous. Consequently, even though various methods were tried, coexistence of improvement in high speed and prevention of latent image regression was difficult to attain sufficiently.

SUMMARY OF THE INVENTION

An object of the present invention is to provide an emulsion having a high silver chloride content, which has high sensitivity and low fogging, and further which is low in both high illumination intensity reciprocity characteristics and regression of latent image. Another object of the present invention is to provide a light-sensitive material using the same.

Other and further objects, features, and advantages of the invention will appear more fully from the following description.

DETAILED DESCRIPTION OF THE INVENTION

As a result of an intensive investigation in consideration of the above-mentioned objects, the present inventors have discovered that the foregoing objects are accomplished by an emulsion containing silver halide grains in which the proportion of metal gold among gold existing on the part of the silver halide grains after gold sensitization is in the fixed range. The present invention has been made on the basis of this new knowledge.

Namely, the following silver halide emulsion and a silver halide color photographic light-sensitive material are provided according to the present invention.

(1) A silver halide emulsion comprising gold-sensitized silver halide grains having a silver chloride content of 95 mole % or more, wherein from 8% to 50% of the amount of gold existing on the part of the silver halide grains is in the state of metal gold.

(2) The silver halide emulsion as described in (1), wherein the amount of gold existing on the part of the silver halide grains in the emulsion is in the range of 40% to 80%, based on the total amount of gold in the emulsion.

(3) The silver halide emulsion as described in (1) or (2), wherein the total amount of gold in the emulsion is in the range of $0.05A\times10^{-4}$ mole to $1.2A\times10^{-4}$ mole per mole of silver halide, assuming that A ($\mu$m) is the side length of a cube whose volume is equal to the volume of the silver halide grain (the equivalent cube side length).

(4) A silver halide color photographic light-sensitive material having a support and having thereon at least one silver halide emulsion layer comprising the silver halide emulsion described in (1), (2), or (3).

The term "gold existing on the part of the silver halide grains" as used herein means gold that exists on the surface and/or inside of the silver halide grains. In other words, it means gold or ions thereof that are detected together silver halide grains when a silver halide emulsion is divided into the silver halide grain part and other component part.

In the present invention, the silver chloride content of the silver halide grains is from 95 mole % to 100 mole %, preferably from 98 mole % to 100 mole %. Further, it is preferable that silver bromide and/or silver iodide may be present outside the foregoing range.

The silver bromide content is preferably in the range of 0.01 mole % to 5 mole %, more preferably from 0.1 mole % to 1 mole %. The silver iodide content is preferably in the range of 0.01 mole % to 1 mole %, more preferably from 0.06 mole % to 0.1 mole %.

The silver bromide, the silver iodide, or the mixed crystals composed of silver chloride and silver bromide and/or silver iodide, may be used preferably inside the grain without any limitation of the position to be incorporated. However, it is preferable that they are incorporated particularly after 50% of grain formation has been accomplished. It is also preferable that they are used in the localized phase of the surface and the vicinity thereof, and/or the near surface.

In the present invention, a silver bromide-rich phase is preferably provided to the silver halide grains having a silver chloride content of 95 mole % or more. Preferably the silver bromide-rich phase is prepared by epitaxially growing a localized phase having a silver bromide content of 10 mole % or more in terms of the content (percentage) of total silver bromide in the silver bromide-rich phase.

The silver bromide content of the silver bromide-rich phase is preferably 10 mole % or more in total. However, if the silver bromide content excessively high, the silver bromide-rich phase sometimes imparts unpreferable characteristics against the photographic light-sensitive material, such that when a pressure is applied to a light-sensitive material, desensitization occurs, and that sensitivity and/or gradation are substantially altered by fluctuation in the composition of a processing solution. Taking these points into consideration, the silver bromide content of the silver bromide-rich phase is preferably in the range of 10 mole % to 60 mole %, most preferably in the range of 20 mole % to 50 mole %. The silver bromide content of the silver bromide-rich phase can be analyzed according to X-ray diffraction method (for example, *Shin-Jikken Kagaku Koza 6, Kozo Kaiseki* (*New Experimental Chemistry Course 6, Analysis of Structure*), edited by Nihon kagaku kai, published by Maruzen), or the like. The silver bromide-rich phase is preferably composed of 0.1 mole % to 5 mole %, more preferably 0.3 mole % to 4 mole % of the total silver amount of the silver halide grains for use in the present invention.

The steps of preparing the silver halide emulsion of the present invention is composed of a silver halide grain-forming step consisting of a reaction between a water-soluble silver salt and a water-soluble halide, a desalting step, and a chemical ripening step, as generally known in the art. In present invention, the silver bromide-rich phase may be provided in any course of the foregoing steps. However, the silver bromide-rich phase is preferably provided after the desalting step, especially preferably after completion of the desalting step but until completion of chemical sensitization. It is preferred to incorporate complex ions of metals of group VIII such as $IrCl_6^{3-}$ in the silver bromide-rich phase. Further, when an iridium compound is incorporated in the silver bromide-rich phase of the silver halide emulsion grains, it is preferable that said rich phase is deposited together with at least 50 mole % of the total iridium to be added at the time of preparation of silver halide grains. It is more preferable that said rich phase is deposited together with at least 80 mole % of the total iridium to be added. It is most preferable that said rich phase is deposited together with the total iridium to be added. The phrase "said rich phase is deposited together with iridium" as used herein means that an iridium compound is supplied at the same time as a silver or halogen supply, just before a silver or halogen supply, or immediately after a silver or halogen supply, for formation of said rich phase. In the case where a silver bromide-rich phase is formed by mixing silver halide host grains and silver halide fine grains having a shorter average grain size and higher silver bromide content than those of said host grains and thereafter by ripening the resulting mixture, it is preferable that an iridium salt is previously incorporated in the silver halide fine grains having a high silver bromide content.

The silver halide grains for use in the present. invention may be those having (100) planes, those having (111) planes, or those having both (100) planes and (111) planes on an outer surface area, or they may contain higher dimensional planes. However, cube and tetradecahedron, each of which is mainly composed of (100) planes, are preferred. The size of the silver halide grains for use in the present invention may be in the range of the grain size usually employed in the art. However, the average grain size (equivalent sphere diameter) is preferably 0.7 $\mu$m or less, more preferably in the range of 0.1 $\mu$m to 0.5 $\mu$m. The term "equivalent sphere diameter" as used herein refers to the diameter of the sphere corresponding to the volume of grains. The grain size distribution may be a polydispersion or monodispersion. The latter is preferred. The variation coefficient of the grain size that indicates the degree of the monodispersion is preferably 0.2 or less, more preferably 0.15 or less, in terms of the ratio (s/d) of a standard deviation (s) to an average grain size (d). Further, preferably blending of two or more of the foregoing monodisperse emulsions can be carried out.

With respect to the shape of silver halide grains, those having a regular crystal form, such as cubic, tetradecahedral or octahedral, an irregular crystal form, such as spherical, tabular, or the like, or a composite form of these forms, can be used. Further, grains having a mixture of these various crystal forms may be also used.

It is preferred in the present invention that the proportion of the grains having such a regular crystal form as described above to the entire grains be 50 mass % or more, preferably 70 mass % or more, and more preferably 90 mass % or more. Further, in addition to the grains having a regular crystal form, an emulsion in which the proportion of tabular grains having an average aspect ratio (equivalent circular diameter/thickness) of 5 or more, preferably 8 or more, to the entire grains is 50% or more as a projected area is also preferably used.

The silver halide emulsion that is used in the present invention can be prepared according to the methods disclosed, for example, in P. Glafkides, *Chimie et Physique Photographique*, Paul Montel (1967), G. F. Duffin, *Photographic Emulsion Chemistry*, Focal Press (1966), V. L. Zelicman, et al., *Making and Coating Photographic Emulsion*, Focal Press (1964), and so on. That is, any process, such as an acid process, a neutral process, and an ammoniacal process, can be used. Any of a single jet method, a double jet method, and a combination of them may be used as methods for reacting a soluble silver salt with a soluble halide. A method in which silver halide grains are formed in the atmosphere of excessive silver ion (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially a uniform grain size distribution can be obtained.

The emulsion of the present invention preferably contains a thiocyanate. Typical examples thereof include a sodium salt and a potassium salt. The timing of addition thereof is not limited to any particular step(s). However, it is preferred to add the thiocyanate in the course of after formation of grains until completion of chemical sensitization. The amount of the thiocyanate to be added is preferably in the range of $1\times10^{-4}$ mole to $3\times10^{-3}$ mole, more preferably $2\times10^{-4}$ mole to $1\times10^{-4}$ mole, per mole of silver halide.

Into the silver halide emulsion of the present invention, various kinds of polyvalent metal ion impurities may be incorporated in the course of grain formation or physical ripening of the emulsion. Examples of the compound to be used include salts or complex salts of metals of GroupVIII of the periodic table, such as iron, iridium, ruthenium, osmium, rhenium, rhodium, cadmium, zinc, lead, copper, and thallium. These compounds may be used in combination. It is especially preferred in the present invention to use a metal compound having at least four cyan ligands and a metal such as iron, ruthenium, osmium and rhenium from the viewpoint that a high illumination intensity speed is further enhanced and also sensitization of latent image is prevented. Further, an iridium compound also exerts a great effect on impartment of a high illumination intensity exposure suitability. The amount of these compounds to be added spreads over a wide range depending on how they are used. However, the amount is preferably in the range of $10^{-9}$ mole to $10^{-2}$ mole, per mole of silver halide. These metal ions are further explained below in detail. However, the present invention is not limited to them.

Iridium ion-containing compounds are a trivalent or tetravalent iridium salt or complex salt. Complex salts are preferred. Preferable examples thereof include halogen, ammine or oxalato (complex) salts, such as primary iridium (III) (iridous) chloride, primary iridium (III) (iridous) bromide, secondary iridium (IV) (iridic) chloride, sodium hexachloro iridate (III), potassium hexachloro iridate (IV), a hexaammine iridium (IV) salt, a trioxalato iridate (III) salt, and a trioxalato iridate (IV) salt.

Platinum ion-containing compounds are a divalent or tetravalent salts or complex salts. Complex salts are preferred. For example, platinum (IV) chloride, potassium hexachloro platinate (IV), hydrogen tetrachloro platinate (II), hydrogen tetrachloro platinate (II), hydrogen tetrabromo platinate (II), sodium-tetrakis (thiocyanato) platinate (II) and hexaanmuine platinum(IV) chloride are used.

Palladium ion-containing compounds are generally a divalent or tetravalent iridium salt or complex salt. Complex salts are especially preferred. For example, sodium tetrachloro palladate (II), sodium hexachloro palladate (IV), potassium hexachloro palladate (IV), tetraammine palladate (II) chloride, and potassium tetracyano palladate (II) are used. As a nickel ion-containing compound, use can be made of, for example, nickel chloride, nickel bromide, potassium tetrachloro nickelate (II), hexaammine nickel (II) chloride, and sodium tetracyano nickelate (II).

As a rhodium ion-containing compound, trivalent salts or complex salts are generally preferred. For example, potassium hexachloro rhodate, sodium hexabromo rhodate and ammonium hexachloro rhodate are used. Iron ion-containing compounds are divalent or trivalent iron ion-containing compounds. Iron salts or complex salts having water solubility in the range of concentration to be used are preferred. Iron complex salts which are easily doped into silver halide grains, are especially preferred. Examples of the iron ion-containing compounds include ferrous chloride, ferric chloride, ferrous hydroxide, ferric hydroxide, ferrous thiocyanate, ferric thiocyanate, hexacyano ferrate (II), hexacyano ferrate (III) a ferrous thiocyanate complex salt and a ferric thiocyanate complex salt. Further, a 6-coordination metal complex having at least four cyan ligands, as described in EP 0,336,426 A, can also be preferably used.

These metal ion-donating compounds can be included in the silver halide grains of the present invention by means of addition to an aqueous solution of gelatin as a dispersion medium, an aqueous solution of halide, an aqueous solution of silver salt or other aqueous solution, at the time of the formation of silver halide grains, or by means of addition in the form of silver halide grains which have previously contained the metal ion and dissolving these grains.

The addition of the metal ions for use in the present invention to grains of an emulsion can be carried out before formation of grains, during formation of grains, or immediately after formation of grains. The time of the addition can be varied depending on the position of grains where the metal ion is to be included.

The silver halide emulsion of the present invention need to be chemically sensitized with a gold compound. It is preferred that the silver halide emulsion is subjected to gold sensitization as known in the art. In order to conduct gold sensitization, compounds such as chloro auric acid, or a salt thereof, gold thiocyanates, gold thiosulfates, and colloidal gold sulfide may be used. The amount of these compounds to be added may spread over a wide range corresponding to the occasion. However, the amount is generally in the range of $5\times10^{-7}$ mole to $5\times10^{-3}$ mole, preferably in the range of $1\times10^{-6}$ mole to $1\times10^{-4}$ mole, per mole of silver halide.

The amount of a gold sensitizer to be used in the present invention is preferably in the range of $0.05\ A\times10^{-4}$ mole to $1.2\ A\times10^{-4}$ mole, more preferably in the range of $0.2\ A\times10^{-4}$ mole to $1.0\ A\times10^{-4}$ mole, per mole of silver halide, supposing that a silver halide grain are a cube having the same volume as the grain and that the side length of the cube is A ($\mu$m).

With respect to the silver halide grains gold-sensitized with the foregoing sensitizer, the percentage of metal gold existing on the part of the grains is from 8% to 50%, preferably from 10% to 30%, of the total amount of gold existing on the part of the grains.

The percentage of the amount of gold existing on the part of the grains to the total amount of gold in the emulsion is preferably in the range of 40% to 80%, more preferably in the range of 40% to 60%. The foregoing amounts of total gold in the emulsion, gold existing on the part of the grains, and metal gold can quantitatively be determined by the method described in Example 1.

In the present invention, gold sensitization may be combined with other sensitizations such as sulfur sensitization, selenium sensitization, tellurium sensitization, reduction sensitization, or noble metal sensitization using a noble metal compound other than a gold compound.

In the present invention, it is indeed effective to reduce an amount of gelatin to be used as a protective colloid, in order to increase the ratio of gold on the part of silver halide grains to the total amount of gold in the emulsion. However, if the amount of gelatin is excessively reduced, a bad effect on that a percentage of the metal gold reduces, occurs. In the emulsion of the present invention, the amount of gelatin to be used is preferably in the range of 20g to 70g per kg of the emulsion. In addition, even though a reduction in pAg or an increase in the amount of a sulfur sensitizer raises a percentage of gold on the part of silver halide grains, such a method alone rather unpreferably decreases a percentage of metal gold. It is important that these factors are well balanced to realize the state of gold sensitization defined by the present invention for improvement in both high illumination intensity reciprocity law failure and sensitization or desensitization of a latent image.

In order to obtain an emulsion having a high percentage of the metal gold on the part of silver halide grains as defined by the present invention, the amount by molar ratio of a sulfur sensitizer to a gold sensitizer is preferably in the range of 1 (equivalent) to 1/4. It was found that metal gold is easily produced particularly in the range of 2/3 to 1/3 which is a relatively low amount of the sulfur sensitizer.

Further, as one of means for realizing an emulsion having a high percentage of the metal gold on the part of silver halide grains, preferred is a ripening temperature of chemical sensitization of 72° C. or more, which is seemed that almost no prior art relative to chemical sensitization of silver chloride has been known to the public until now. The ripening at the temperature ranging from 72° C. to 90° C. is more preferred. Beside, the ripening time, even though it varies according to the reaction speed of a chemical sensitizer, is preferred to spend 60 minutes or longer, more preferably from 60 to 240 minutes. At the time of chemical sensitization, the pAg is preferably in the range of about 7.0 to about 8.2, while such a low pH as about 5.0 to about 6.2 is preferred.

Various compounds or precursors thereof can be included in the silver halide emulsion for use in the present invention to prevent fogging from occurring or stabilize photographic performances during manufacture, storage or photographic processing of the photographic material. That is, as a compound which can be added to the silver halide emulsion, there are many compounds known as an antifogging agent or stabilizer such as azoles, for example, benzothiazoliums, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole and the like); mercaptopyrimidines, mercaptotriazines; thioketo compounds such as oxazolinethione; azaindenes, for example, triazaindenes, tetrazaindenes (particularly 4-hydroxy-substituted(1,3,3a,7)tetrazaindene), and pentazaindenes; benzenethiosulfonic acid, benzenesulfinic acid, and benzenesulfonamide. Mercaptotetrazoles are especially preferred. These compounds preferably act so that a high illumination intensity speed can be further enhanced in addition to antifogging and stabilization.

As a hydrophilic binder which may be used in the silver halide color photographic light-sensitive material of the present invention, gelatin is used. But, as occasion demands, gelatin may be used in combination with any other hydrophilic colloid such as other gelatin derivatives, graft copolymers of gelatin and other high molecules, proteins other than gelatin, sugar derivatives, cellulose derivatives, and synthetic hydrophilic high molecular materials such as homo- or co-polymers.

The gelatin which can be used in the silver halide color photographic light-sensitive material of the present invention may be a lime-treated gelatin, or an acid-treated gelatin. Further, it may be a gelatin manufactured by employing any one of a cattle bone, a cattle skin and a pig skin as a raw material. A lime-treated gelatin manufactured by employing the cattle bone, or the pig skin as a raw material is preferred.

In the present invention, the total amount of a hydrophilic binder to be contained in light-sensitive emulsion layers and light-insensitive hydrophilic colloid layers extending from a support to the hydrophilic colloid layers furthest from the silver halide emulsion-coating side of the support, is preferably 8.0 g/m$^2$ or less, most preferably from 7.0 g/m$^2$ to 4.0 g/m$^2$, from the viewpoint of a rapid processing. A small amount of a hydrophilic binder has an effect especially on advances in both color developing and washing speed.

In the present invention, a yellow coupler-containing silver halide emulsion layer may be disposed at any position on a support. However, in the case where silver halide tabular grains are contained in the yellow coupler-containing layer, it is preferable that the yellow coupler-containing layer be coated further from a support than at least one of a magenta coupler-containing silver halide emulsion layer and a cyan coupler-containing silver halide emulsion layer. Further, it is preferable that the yellow coupler-containing silver halide emulsion layer be coated furthest from a support of other silver halide emulsion layers, from the viewpoint of color development acceleration, desilvering acceleration, and reduction in a residual color. Further, it is preferable that the yellow coupler-containing silver halide emulsion layer be disposed in the middle of other silver halide emulsion layers, from the viewpoint of reduction in a blix fading. On the other hand, it is preferable that the yellow coupler-containing silver halide emulsion layer be the lowest layer, from the viewpoint of reduction in a light fading. Further, each of a yellow-coloring layer, a magenta-coloring layer and a cyan-coloring layer may be composed of two or three layers. It is also preferable that a coloring layer be formed by disposing a silver halide emulsion-free layer containing a coupler in adjacent to a silver halide emulsion layer as described in, for example, JP-A-4-75055, JP-A-9-114035, JP-A-10-246940, and U.S. Pat. No. 5,576,159.

In the yellow coupler-containing silver halide emulsion layer, the amount of a hydrophilic binder is preferably 1.55 g/m$^2$ or less, more preferably 1.45 g/m$^2$ or less, and most preferably from 1.35 g/m$^2$ to 0.60 g/m$^2$ Further, with respect to the width of silver halide grains, when cubic grains are used, the side length of the grain is preferably from 0.70 $\mu$m to 0.30 $\mu$m. On the other hand, when tabular grains are used, the side length of the grain is preferably from 0.40 $\mu$m to 0.02 $\mu$m, more preferably 0.30 $\mu$m or less, still more preferably 0.20 $\mu$m or less, and most preferably from 0.15 $\mu$m to 0.05 $\mu$m. The aspect ratio of the tabular grain is preferably in the range of 2 to 10, more preferably in the range of 3 to 8. Further, in order to control sensitivity, gradation, and other photographic properties, the silver halide emulsion is preferably used in a mixture of emulsions having a different size or shape from each other.

In the present invention, the coating amount of the silver halide emulsion is preferably from 0.70 g/m$^2$ to 0.10 g/m$^2$, more preferably from 0.65 g/m$^2$ to 0.20 g/m$^2$, and most preferably from 0.55 g/m$^2$ to 0.25 g/m$^2$ When cubic silver halide grains are used in a cyan-coloring layer and a magenta-coloring layer, the side length of the grain is preferably 0.70 $\mu$m or less and more preferably from 0.50 $\mu$m to 0.10 $\mu$m.

The term "film thickness of photographic constituent layers" as used herein, refers to a thickness of the total photographic constituent layers on a support before they are subjected to a processing. Specifically, the film thickness can be measured by any one of the following methods.

First, a silver halide color photographic light-sensitive material is cut perpendicular to the support thereof, and the resulting section is observed by a microscope to measure it. The second method is a method in which a film thickness is calculated on the basis of a coating amount (g/m$^2$) and specific gravity of each of ingredients in the photographic constituent layers.

For example, the specific gravity of a typical gelatin which is used for a photography is 1.34 g/ml, and that of silver chloride is 5.59 g/ml. In addition, by measuring specific gravity of other lipophilic additives before coating, a film thickness is calculated according to the second method.

In the present invention, the film thickness of photographic constituent layers is preferably 10.0, am or less, more preferably 9.5 $\mu$m or less, and most preferably from 9.0 $\mu$m to 3 $\mu$m.

The term "hydrophobic material for a photography" as used herein, refers to an oil-soluble part excluding a dye-forming coupler. The term "oil-soluble part" as used herein, refers to lipophilic ingredients remaining in a light-sensitive material after processing. Specifically, examples of the oil-soluble part include a dye-forming coupler, a high boiling point organic solvent, a color mixing-preventing agent, an ultraviolet ray-absorbing agent, lipophilic additives, an lipophilic polymer or a polymer latex, a matting agent and a sliding agent. In addition, they are usually added as lipophilic fine particles to a photographic constituent layer. Accordingly, a water-soluble dye, a hardening agent, other water-soluble additives, a silver halide emulsion and the like do not belong to the oil-soluble part. Further, generally a surfactant is used when lipophilic fine particles are prepared. But, in the present invention, the surfactant is not included in the oil-soluble part.

In the present invention, the total amount of the oil-soluble part is preferably 5.5 g/m$^2$ or less, more preferably 5.0 g/m$^2$ or less, and most preferably from 4.5 g/m$^2$ to 3.0 g/m$^2$m . In the light-sensitive material of the present invention, the value of the mass (g/m$^2$) of hydrophobic materials for a photography, contained in a dye-forming coupler-containing layer divided by the mass (g/m$^2$) of said dye-forming coupler, is preferably 4.5 or less, more preferably 3.5 or less, and most preferably from 3.0 or less.

In the present invention, the ratio of the oil-soluble part to a hydrophilic binder in the photographic constituent layers may be optionally fixed. The foregoing ratio by mass in the photographic constituent layers excluding a protective layer is preferably in the range of 0.05 to 1.50, more preferably in the range of 0.10 to 1.40. Film strength, scratch resistance and curl characteristics can be controlled by optimizing the ratio in each of the photographic constituent layers.

To improve the sharpness of the image and the like, it is preferred to add a dye which can be discolored by a processing (oxonol-based dyes of all), disclosed in EP 0,337,490 A2, pages 27 to 76, to the hydrophilic colloidal layer of the light-sensitive material of the present invention, so that an optical reflection density at 680 nm of said light-sensitive material becomes 0.50 or more. Alternatively it is also preferred to add a titanium oxide which has been previously surface-treated with any one of divalent to tetravalent alcohols (e.g., trimethylol ethane) and the like, to a water-proof resin layer of a support in an amount of 12% by mass or more (more preferably 14% by mass or more).

Other known materials and additives for a photography can be also used for the silver halide light-sensitive material of the present invention.

For example, as a photographic support, a transmitting support and a reflective support can be used. As a transmitting support, transmitting films such as a cellulose nitrate film and a polyethyleneterephthalate film; and polyesters of 2,6-naphthalenedicarboxylic acid (NDCA) and ethyleneglycol (EG) and polyesters of NDCA, terephthalic acid and EG, each of which has thereon an information-recording layer such as a magnetic layer, are preferably used. As a reflective support, reflective supports having thereon a water-proof resin layer (a laminate layer) formed by laminating with a plurality of polyethylene layers or polyester layers, at least one of constituent layers of said water-proof resin layer containing a white pigment such as titanium oxide, are especially preferred.

Further, it is preferred to contain a fluorescent brightening agent in the foregoing water-proof resin layer. Further, the fluorescent brightening agent may be dispersed in a hydrophilic colloidal layer of the light-sensitive material. The fluorescent brightening agents which can be preferably used, are benzoxazole-based, coumarin-based and pyrazoline-based compounds, more preferably benzoxazolylnaphthalene-based and benzoxazolylstilbene-based compounds. Although there is no particular restriction on the amount of the compound used in the present invention, the amount is preferably in the-range of 1 mg/m$^2$ to 100 mg/m$^2$. In the case where the fluorescent brightening agent is mixed with a water-proof resin, the mixing ratio thereof is preferably in the range of 0.0005 to 3% by mass, more preferably in the range of 0.001 to 0.5% by mass, based on the resin.

As a reflective support, a transmitting support or the above-described reflective support, on each of which a hydrophilic colloidal layer containing a white pigment is coated, may be also used.

Further, the reflective support may be a support having thereon a metal surface providing a mirror surface reflection or a diffusion reflection of second kind.

As the above-described reflective support, the silver halide emulsion, the different kinds of metal ions to be doped in the silver halide grains, the storage stabilizers or antifogging agents of the silver halide emulsion, the methods of chemical sensitization (sensitizers), the methods of spectral sensitization (spectral sensitizing dyes), the cyan, magenta, and yellow couplers and the emulsion dispersion methods thereof, the dye stability-improving agents (stain inhibitors and discoloration inhibitors), the dyes (coloring layers), the kinds of gelatin, the layer composition of the light-sensitive material and the film pH of the light-sensitive material, those described in the patents shown in Tables 1 and 2 are preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |

TABLE 1-continued

| Element | JP-A-7-104448 | JP-A-7-77775 | JP-A-7-301895 |
|---|---|---|---|
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-storability improving agents (anti-stain agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As other cyan, magenta and yellow couplers which can be used in combination in the present invention, those disclosed in JP-A-62-215272, page 91, right upper column line 4 to page 121, left upper column line 6, JP-A-2-33144, page 3, right upper column line 14 to page 18, left upper column bottom, and page 30, right upper column line 6 to page 35, right under column, line 11, European Patent No. 0355,660 A2, page 4 lines 15 to 27, page 5 line 30 to page 28 bottom, page 45 lines 29 to 31, page 47 line 23 to page 63 line 50, JP-A-8-122984 and JP-A-9-222704, are also advantageously used. Further, as the cyan coupler, pyrrolotriazole couplers are preferably used. Among these couplers especially preferred are those represented by formula (I) or (II) in JP-A-5-313324 and those represented by formula (I) in JP-A-6-347960 and exemplified couplers described in these patents.

In the present invention, known color mixing-inhibitors may be used. Among these compounds, those described in the following patents are preferred.

For example, high molecular weight redox compounds described in JP-A-5-333501; phenidone- or hydrazine-based compounds as described in, for example, Japanese patent application No. 9-140719 and U.S. Pat. No. 4,923,787; and white couplers as described in, for example, JP-A-5-249637, JP-A-10-282615 and German Patent No. 19629142 A1, may be used. Further, in order to accelerate a developing speed by increasing the pH of a developing solution, redox compounds described in, for example, German Patent Nos. 19,618,786 A1 and 19,806,846 A1, European Patent Nos. 0,839,623 A1 and 0,842,975 A1, and French Patent No. 2,760,460 A1, are also preferably used.

In the present invention, as an ultraviolet ray absorbent, it is preferred to use compounds having a high molar extinction coefficient. Examples of these compounds include those having a triazine skeleton. Among these compounds preferred are those described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, Japanese published searched patent publication No. 8-501291, European Patent No. 0,711,804 A and German Patent No. 19,739,797A.

The antibacterial (fungi-preventing) agent and antimold agent for use in the present invention are those described in JP-A-63-271247.

As the hydrophilic colloidal layer which can be used in photographic layers to constitute the light-sensitive material, gelatin is preferred. In particular, it is desirable for the gelatin used in the present invention that the content of heavy metals, such as Fe, Cu, Zn and Mn, as impurities therein be reduced to 5 ppm or below, preferably 3 ppm or below.

Further, the amount of calcium contained in the light-sensitive material is preferably 20 mg/m$^2$ or less, more preferably 10 mg/m$^2$ or less, and most preferably from 5 mg/m$^2$ or less.

The light-sensitive material of the present invention can preferably be used, in addition to the printing system using a general negative printer, in a scanning exposure system using the cathode rays (CRT).

The cathode ray tube exposure apparatus is simpler and more compact, and therefore inexpensive than a laser-emitting apparatus. Further, optical axis and color (hue) can easily be adjusted.

In a cathode ray tube which is used for an image exposure, various light-emitting materials which emit a light in the spectral region, are used as occasion demands. For example, any one of red light-emitting materials, green light-emitting materials, blue light-emitting materials, or a mixture of two or more of these light-emitting materials may be used. Particularly, a cathode ray tube which emits a white light by means of a mixture of these light-emitting materials, is often used.

In the case where the cathode ray tube has a fluorescent substance which emits light in a plurality of spectral regions, exposure to a plurality of colors may be carried out at the same time. Namely, plural color image signals may be inputted into a cathode ray tube to allow light to be emitted from the surface of the tube. Alternatively, a method in which an image signal of each of colors is successively inputted and light of each of colors is emitted in order, and then exposure is carried out through a film capable of cutting a color other than the emitted color, i.e., a surface successive exposure, may be used. Generally, among these methods the surface successive exposure is preferred from the viewpoint of high image quality enhancement, because a cathode ray tube having high resolution can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor or a solid state laser using a semiconductor as an excitation light source. It is preferred to use a semiconductor laser, or a second harmonic generation light source (SHG) comprising a combination of nonlinear optical crystal with a semiconductor or a solid state laser for obtaining a compact and inexpensive system. Particularly, to design compact and inexpensive apparatus having a longer duration of life and high stability, a semiconductor laser can preferably used, and it is preferred that at least one of exposure light sources should be a semiconductor laser.

As oscillation wave length of a laser can be made half using a SHG light source comprising a combination of nonlinear optical crystal with a semiconductor or a solid state laser using a semiconductor as an excitation light source, blue light and green light can be obtained. Accordingly, it is possible to use a photographic material having the spectral sensitivity maximum in normal three regions of blue, green, and red to obtain an image.

The exposure time for the scanning exposure is defined as the time necessary to expose the size of the picture element (pixel) with the density of the picture element being 400 dpi, and preferred exposure time is $10^{-4}$ sec or less and more preferably $10^{-6}$ sec or less.

The scanning exposure system which can preferably be used for the present invention is described in detail in the patents shown in the above tables.

With respect to the processing method of the color photographic material of the present invention, processing materials and processing methods disclosed in JP-A-2-207250, from page 26, right under column, line 1 to page 34, right upper column, line 9, and JP-A-4-97355, from page 5, left upper column, line 17 to page 18, right under column, line 20 are preferred. Further, as preservatives which are used in the developing solution, compounds described in the patents shown in the above tables are preferably used.

Examples of a development method applicable to photographic materials of the present invention after exposure include a wet development method such as a conventional development method using a developing solution containing an alkali agent and a developing agent, a development method wherein a developing agent is incorporated in the light-sensitive material and an activator solution, e.g., a developing agent-free alkaline solution, is employed for the development, and a heat development method using no processing solution. In particular, the activator method using a developing agent-free alkaline solution is preferred over the other methods, because it enables easy management and handling of the processing solution and reduction in waste disposal load to make for environmental preservation.

The suitable developing agents or their precursors incorporated in the photographic materials in the case of adopting the activator method include the hydrazine compounds described in, for example, JP-A-8-234388, JP-A-9-152686, JP-A-9-152693, JP-A-9-211814 and JP-A-9-160193.

Further, the processing method in which the photographic material reduced in silver coverage undergoes the image amplification processing using hydrogen peroxide (intensification processing) is employed to advantage. In particular, it is favorable to apply this processing method to the activator method. Specifically, the image forming methods utilizing an activator solution containing hydrogen peroxide as disclosed in JP-A-8-297354 and JP-A-9-152693 are preferred.

Although the processing with an activator solution is generally followed by a desilvering step in the activator method, the desilvering step can be omitted in the case of applying the image amplification processing method to photographic materials having reduced silver coverage. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied even if the photographic materials are those having high silver coverage, such as picture-taking photographic materials.

The activator solution, desilvering solution (bleach/fixing solution), washing solution and stabilizer used in the present invention can contain known ingredients and can be used in conventional manners. Preferably, those described in *Research Disclosure*, Item 36544, pp. 536–541 (September 1994), and JP-A-8-234388 can be used in the present invention.

The term "color developing time" as used herein refers to a period of time required from the beginning of dipping a light-sensitive material into a color developing solution until the light-sensitive material is dipped into a blix solution in the subsequent processing step. In the case where a processing is carried out using, for example, an automatic processor, the color developing time is the sum total of a time in which a light-sensitive material has been dipped in a color developing solution (so-called "time in the solution") and a time in which after the light-sensitive material has been away from the color developing solution and then conveyed in the air toward a bleach-fixing bath in the subsequent step (so-called "time in the air"). Likewise, the term "blix time" as used herein refers to a period of time required from the beginning of dipping a light-sensitive material into a blix solution until the light-sensitive material is dipped into a washing bath or a stabilizing bath in the subsequent processing step. Further, the term "washing or stabilizing time" as used herein refers to a period of time required from the beginning of dipping a light-sensitive material into a washing solution or a stabilizing solution until a drying step (so-called "time in the solution").

It is preferable that the light-sensitive material of the present invention be rapidly processed. The developing time is preferably 60 sec. or less, more preferably from 50 sec. to 6 sec. Likewise, the blix time is preferably 60 sec. or less, more preferably from 50 sec. to 6 sec. Further, the washing or stabilizing time is preferably 150 sec. or less, more preferably from 130 sec. to 6 sec.

As a drying method for use in the present invention, any methods known as a method of rapidly drying a color photographic light-sensitive material may be used. In view of the object of the present invention, it is preferred that a color photographic light-sensitive material can be dried in the time of 20 sec. or less, more preferably 15 sec. or less, and most preferably in the range of 5 sec. to 10 sec.

As a drying system, any one of a contact heating system and a warm air spray system may be used. But, a combination of these systems is preferred because such a combination system enables more rapid drying than does each of these systems.

A more preferable embodiment of the drying method for use in the present invention is a system in which a light-sensitive material is subjected to a contact heating by heat rollers, followed by a blow drying with a warm air sprayed from a porous plate or nozzles toward the light-sensitive material. It is preferable at the resulting blow-dried portion that the mass velocity of a warm air sprayed per unit area of the heated area of a light-sensitive material be 1000 $Kg/m^2$ hr or more. Further, as a shape of the nozzle of the blower, the shape which enables to reduce a pressure-loss is preferred. For example, those shown by FIGS. 7 to 15 described in JP-A-9-33998 are preferred.

The silver halide emulsion having a high silver chloride content according to the present invention has high sensitivity and low fogging, and reduced both high illumination intensity reciprocity law failure and regression of latent image in the initial stage after exposure. Therefore, the emulsion can preferably be used for a color photographic light-sensitive material having a reflective support. The light-sensitive material of the present invention using the foregoing emulsion has high sensitivity and reduced both high illumination intensity reciprocity law failure and regression of latent image in the initial stage after exposure, whereby an excellent image can be provided.

EXAMPLE

The present invention will be explained in detail by way of the following examples. However, the present invention is not limited to those particular examples.

Example 1

3.7 g of NaCl was added to 1000 ml of an aqueous solution having dissolved therein a deionized gelatin having an average molecular weight of 50,000 so as to become the concentration of 5.8%, to which 0.01 g of Compound-A was further added and stirred at 50° C. while keeping the temperature. Subsequently 0.64 mole of silver nitrate and 0.64 mole of NaCl were added over 17 minutes to form silver chloride grain nuclei.

Thereafter, 1.06 mole of silver nitrate and 1.06 mole of NaCl were added over 30 minutes while accelerating a flow rate to grow the grains. Further, a NaCl solution containing KBr in an amount corresponding to 0.005 mole and yellow prussiate of potash in an amount corresponding to $2\times10^{-5}$ mole, based on the total silver amount respectively, and a silver nitrate solution in an equimolar amount were added at a constant rate. At this time, the final amount of silver nitrate added, amounted to 2.1 mole. The thus-prepared silver chlorobromide fine grains having a bromide content of 0.1 mole % were cubic grains whose average grain size was 0.41/$\mu$m and coefficient of variation was 9.3%.

Then, desalting and washing were performed, and at the time of the dispersion, 170 g of a deionized gelatin was added. After adjusting at 50° C. the pH and pAg of the dispersion to 5.0 and 7.5, respectively, the resulting dispersion was re-dispersed.

To the re-dispersion solution, $8\times10^{-4}$ mole of sodium benzene thiosulfonate was added. Further, $1\times10^{-4}$ mole of a solid dispersion of Sensitizing dye-A and $2\times10^{-4}$ mole of Compound-B were added. Then, $2.5\times10^{-5}$ mole of chloroauric acid and $5\times10^{-6}$ mole of Sulfursensitizer-A were added, per mole of silver halide. Thereafter, the resulting mixture was ripened for 100 minutes while keeping the temperature at 50° C.

After ripening, a fine grain emulsion having an average equivalent sphere diameter of 0.06 $\mu$m and having a silver bromide content of 60 mole % and a silver chloride content of 40 mole % and further containing $6.7\times10^{-5}$ mole/Ag mole of Compound-C, was added by an amount corresponding to 0.25 mole % of silver, and then ripened for 10 minutes. Thereafter, a fine grain emulsion having an average equivalent sphere diameter of 0.06 $\mu$m and having a silver bromide content of 30 mole % and a silver chloride content of 70 mole % was added by an amount corresponding to 0.77 mole %, and then ripened. After that, $1.77\times10^{-3}$ mole of Compound-D was added and ripening was ceased. Further, $2.7\times10^{-3}$ mole of Compound-B was added. The resulting mixture was stirred for 15 minutes, and then the temperature was cooled to 40° C. or less. The thus-prepared emulsion was designated as Emulsion A.

Compound-A

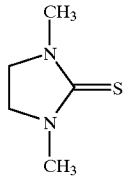

Sensitizing dye-A

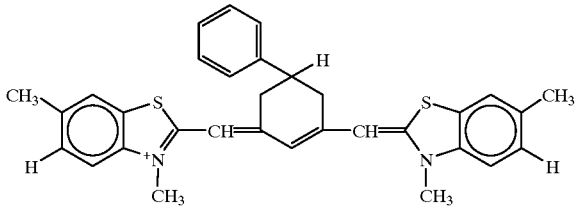

Sulfursensitizer-A

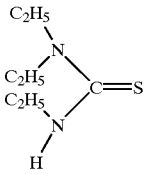

Compound-B

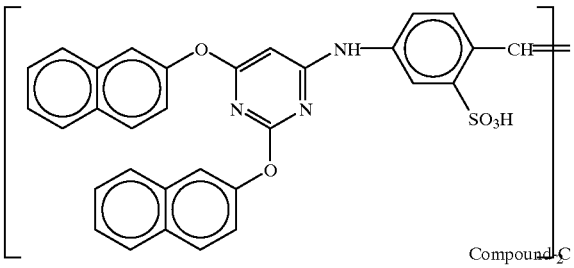

Compound-C $K_3IrCl_6$

Compound-D

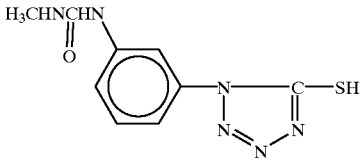

Next, Emulsions B to L were prepared in the same manner as the Emulsion A, except that the addition amounts of both chloroauric acid and sulfur sensitizer-A, and the ripening temperature and time after addition were changed as shown in Table 3.

TABLE 3

| Emulsion No. | Amount of chloroauric acid (mol/Ag mol) | Amount of sulfur-sensitizer (mol/Ag mol) | Amount of dispersed gelatin | Ripening temperature | Ripening time |
|---|---|---|---|---|---|
| A | $2.5 \times 10^{-5}$ | $5 \times 10^{-6}$ | 170 g | 50° C. | 100 min |
| B | $2.5 \times 10^{-5}$ | $3 \times 10^{-6}$ | 170 g | 70° C. | 100 min |
| C | $2.5 \times 10^{-5}$ | $3 \times 10^{-6}$ | 170 g | 76° C. | 100 min |
| D | $3.5 \times 10^{-5}$ | $3 \times 10^{-6}$ | 170 g | 76° C. | 100 min |
| E | $1.5 \times 10^{-5}$ | $3 \times 10^{-6}$ | 170 g | 76° C. | 100 min |
| F | $1.5 \times 10^{-5}$ | $2 \times 10^{-6}$ | 170 g | 76° C. | 100 min |
| G | $1.5 \times 10^{-5}$ | $1 \times 10^{-6}$ | 170 g | 76° C. | 100 min |
| H | $1.5 \times 10^{-5}$ | $1.5 \times 10^{-6}$ | 170 g | 76° C. | 150 min |
| I | $2.5 \times 10^{-5}$ | $1 \times 10^{-5}$ | 170 g | 50° C. | 70 min |
| J | $2.5 \times 10^{-5}$ | $3 \times 10^{-6}$ | 140 g | 76° C. | 100 min |

TABLE 3-continued

| Emulsion No. | Amount of chloroauric acid (mol/Ag mol) | Amount of sulfur-sensitizer (mol/Ag mol) | Amount of dispersed gelatin | Ripening temperature | Ripening time |
|---|---|---|---|---|---|
| K | $2.5 \times 10^{-5}$ | $3 \times 10^{-6}$ | 110 g | 76° C. | 100 min |
| L | $2.5 \times 10^{-5}$ | $3 \times 10^{-6}$ | 80 g | 76° C. | 100 min |

With respect to gold in the thus-prepared emulsion, the following evaluations were conducted.

The percentage of gold on the silver halide grains (on the part of grains) was measured as follows:

First, the sample emulsion was diluted with ten times of a deionized water to prepare a solution A, and then a gelatin-decomposing enzyme was added thereto. The resulting mixture was subjected to a centrifugal separation at the rate of 10,000 round per minute for 30 minutes using a separator, to result in a separation of a supernatant liquid B and a precipitate. Thereafter, the precipitate alone was diluted with the same amount of a deionized water as the initial diluent and then dissolved therein to prepare a solution C.

Next, gold ions of each of these liquids were analyzed by means of an induced coupling plasma mass spectrum spectroscope (HP4500 manufactured by YOKOKAWA Analytical Systems Co., Ltd.).

For the quantitative analysis, a working curve was prepared using standard samples to which chloroauric acid alone was previously added in a variant amount.

Among the amounts of gold detected from the solution A, the supernatant liquid B and the solution C in which the precipitate is re-dissolved, the following equation is approximately established:

Amount of Gold in Solution *A*=(Amount of Gold in Supernatant liquid *B*)+(Amount of Gold in Solution *C*)

The percentage of gold on the part of silver halide grains was measured, based on the following equation:

Percentage (%) of gold on the part of silver halide grains=(Amount of gold in Solution *C*/Amount of gold in Solution *A*)×100

Next, the percentage of metal gold on the part of silver halide grains was measured as follows.

First, samples in which KCN has been added to a sample emulsion composed of silver halide grains about ten times the amount of chloroauric acid contained in the same sample emulsion to remove gold ions on the part of silver halide grains, were prepared.

These sample emulsions were treated in the same manner as above, and the amount of metal gold on the part of silver halide grains was measured. At last, the ratio of metal gold to the above-described amount of gold on the part of silver halide grains was measured.

The percentage of gold and metal gold on the part of silver halide grains, which were obtained in this way, are shown in Table 4.

TABLE 4

| Emulsion No. | Percentage of gold on the gold on the part of silver halide grains | Percentage of metal gold on the gold on the part of silver halide grains | This invention / Comparative example |
|---|---|---|---|
| A | 50% | 3% | Comparative example |
| B | 40% | 6% | Comparative example |
| C | 45% | 12% | This invention |
| D | 40% | 13% | This invention |
| E | 50% | 15% | This invention |
| F | 35% | 20% | This invention |
| G | 25% | 30% | This invention |
| H | 40% | 20% | This invention |
| I | 40% | 20% | Comparative example |
| J | 45% | 12% | This invention |
| K | 55% | 11% | This invention |
| L | 65% | 12% | This invention |

Preparation of Emulsion-coating Solution 50 g of a cyan coupler (ExC-1), 220 g of a cyan coupler (ExC-2), 220 g of a dye image stabilizer (Cpd-1), 10 g of a dye image stabilizer (Cpd-9), 10 g of a dye image stabilizer (Cpd-10), 20 g of a dye image stabilizer (Cpd-12), 140 g of an ultraviolet ray absorbent (UV-1), 30 g of an ultraviolet ray absorbent (UV-3) and 60 g of an ultraviolet ray absorbent (UV-4) were dissolved in an mixture of 200 g of a solvent (Solv-6) and 350 ml of ethyl acetate. The mixture was then emulsified and dispersed in 6500 g of a 10% aqueous gelatin solution containing 200 ml of 10% sodium dodecylbenzene sulfonate to obtain an emulsion dispersion C.

The above-described emulsion dispersion C and silver chlorobromide emulsions shown in Table 3 were mixed and dissolved to prepare an emulsion layer-coating solution, which had the following composition. An amount of the applied emulsion was 0.17 g/m$^2$ in terms of silver.

| | |
|---|---|
| Gelatin | 0.98 |
| Cyan Coupler (ExC-1) | 0.05 |
| Cyan Coupler (ExC-2) | 0.22 |
| Ultraviolet ray Absorbent (UV-1) | 0.14 |
| Ultraviolet ray Absorbent (UV-3) | 0.03 |
| Ultraviolet ray Absorbent (UV-4) | 0.06 |
| Dye Image Stabilizer (Cpd-1) | 0.22 |
| Dye Image Stabilizer (Cpd-9) | 0.01 |
| Dye Image Stabilizer (Cpd-10) | 0.01 |
| Dye Image Stabilizer (Cpd-12) | 0.02 |
| Solvent (Solv-6) | 0.02 |
| Protective Layer | |
| Gelatin | 1.00 |
| Acryl-modified Copolymer of Polyvinyl Alcohol (modification degree 17%) | 0.04 |
| Liquid Paraffin | 0.02 |
| Surfactant (Cpd-14) | 0.01 |
| Surfactant (Cpd-15) | 0.01 |

(ExC-1) Cyan Coupler

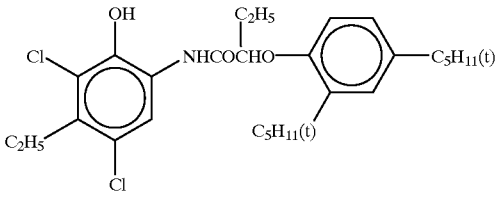

(ExC-2) Cyan Coupler

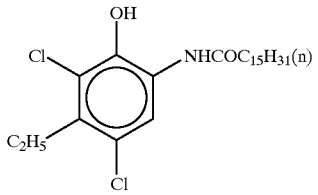

(Cpd-1) Dye Image Stabilizer

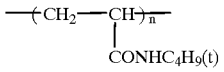

number-average molecular weight 60,000

(Cpd-9) Dye Image Stabilizer

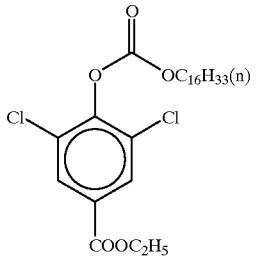

(Cpd-10) Dye Image Stabilizer

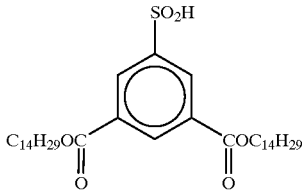

(Cpd-12) Dye Image Stabilizer

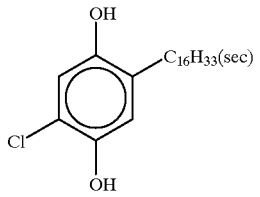

(Cpd-14) Surfactant

A mixture in 7:3 (mass ratio) of

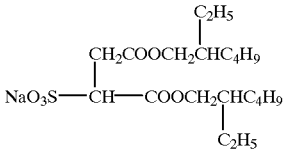

and

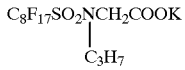

(Cpd-15) Surfactant

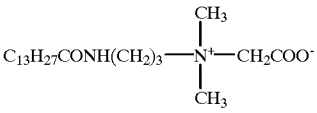

-continued (UV-1) Ultraviolet ray Absorbent

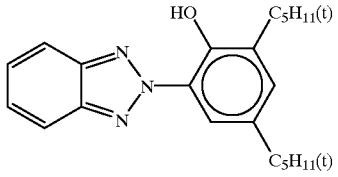

(UV-3) Ultraviolet ray Absorbent

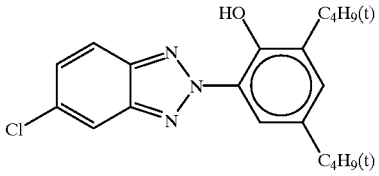

(UV-4) Ultraviolet ray Absorbent

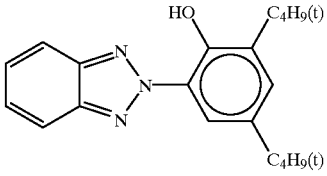

(Solv-6)

A mixture in 1:1 (mass ratio) of

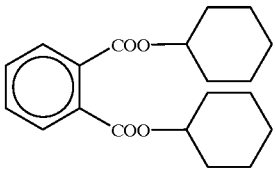

and

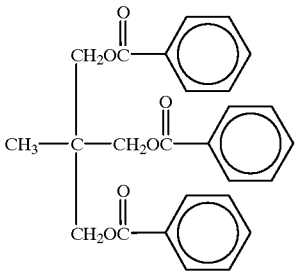

Sensitometry Evaluation Test

Each of samples was stored on the condition of 25° C.-55% RH for a day, and then processed according to the processing steps as described below.

Each of samples was subjected to 200 1× sec of exposure through an wedge which is able to transmit a light of 600 nm or longer with a sensitometer for 0.1 sec. and then processed using the processing steps as described below. The logarithm (log E) of an exposure amount required for providing a colored density of 0.5 was measured and calculated.

Further, each of the samples was subjected to $10^{-4}$ sec. exposure using a xenon high illumination intensity photometer manufactured by EGG Ltd. Processing steps and evaluation for a sensitivity were carried out using a wedge and a filter in the same manner as in the 0.1 sec. exposure. In each case, the sensitivity was represented as a relative value, provided that the sensitivity of sample light-sensitive material No.1 upon 0.1 sec. exposure is equal to 100.

The processing steps are shown below.

Processing A

Each of the above-described light-sensitive materials was cut into a roll having a width of 127 mm and processed using a minilab printer processor (PP1258AR: trade name, manufactured by Fuji Photo Film Co., Ltd.)

The processing was carried out while regulating a relationship between the processing and the exposure, so that development was initiated after the interval of 30 minutes from exposure.

| Processing Step | Temperature | Time | Amount *of replenishment |
|---|---|---|---|
| Color Development | 38.5° C. | 45 sec. | 45 ml |
| Bleach/fixing | 38.0° C. | 45 sec. | 35 ml |
| Rinsing (1) | 38.0° C. | 20 sec. | — |
| Rinsing (2) | 38.0° C. | 20 sec. | — |
| Rinsing (3) | **38.0° C. | 20 sec. | — |
| Rinsing (4) | **38.0° C. | 30 sec. | 121 ml |

*The amount of replenishment is per $m^2$ of light-sensitive material.

**A Rinse (3) is equipped with a rinse cleaning system RC50D (trade name) manufactured by Fuji Photo Film Co., Ltd., and then a rinse solution is taken out from the Rinse (3) and sent to a reverse osmotic film module (RC50D) by means of a pump. A transmitted water obtained in the tub is supplied to a Rinse (4) and a concentrated water is returned to the Rinse (3). A pump pressure was adjusted so that an amount of the transmitted water to the reverse osmotic film module could be maintained at the rate of 50 to 300 ml per minute. A thermo-regulated circulation was carried out for 10 hours a day. Rinsing was performed by tank counterflow from (1) to (4).

The compositions of each of the processing solutions were as follows:

| | Tank solution | Replenishing solution |
|---|---|---|
| [Color developing solution] | | |
| Water | 800 ml | 800 ml |
| Dimethylpolysiloxane-based surfactant (Silicone KF351A (trade name) manufactured by Shinetzu Chemical Co., Ltd.) | 0.1 g | 0.1 g |
| Tri (isopropanol)amine | 8.8 g | 8.8 g |
| Ethylenediamine tetraacetic acid | 4.0 g | 4.0 g |
| Polyethyleneglycol (Molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightening agent (HackolFWA-SF (trade name) manufactured by Showa Chemical Co., Ltd.) | 2.5 g | 5.0 g |
| Sodium sulfite | 0.1 g | 0.1 g |
| Disodium N,N-bis (sulfonatoethyl) hydroxylamine | 8.5 g | 11.1 g |
| N-ethyl-N-(β-methanesulfonamideethyl) -3-methyl-4-amino-4-aminoaniline.3/2 sulfuric acid.1 $H_2O$ | 5.0 g | 15.7 g |
| Potassium carbonate | 26.3 g | 26.3 g |
| Water to make | 1000 ml | 1000 ml |
| pH (at 25° C., adjusted with potassium | 10.15 | 12.50 |

-continued

| | Tank solution | Replenishing solution |
|---|---|---|
| hydroxide and sulfuric acid) | | |
| [Bleach/fixing solution] | | |
| Water | 700 ml | 600 ml |
| Ammonium ethylenediamine tetraacetato ferrite (III) | 47.0 g | 94.0 g |
| Ethylenediaminetetraacetic acid | 1.4 g | 2.8 g |
| m-carboxy benzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/ liter) | 107.0 ml | 214.0 ml |
| Ammonium sulfite | 16.0 g | 32.0 g |
| Ammonium hydrogen sulfite | 23.1 g | 46.2 g |
| Water to make | 1000 ml | 1000 ml |
| pH (at 25° C., adjusted with acetic acid and aqueous ammonia) | 6.0 | 6.0 |
| [Rinsing solution] | | |
| Chlorinated sodium isocyanulate | 0.02 g | 0.02 g |
| Deionized water (conductivity: 5 μs/cm or less) | 1000 ml | 1000 ml |
| pH | 6.5 | 6.5 |

The results which were obtained by sensitometry are shown in Table 5.

From the results in Table 5, it is understood that each of the samples of the present invention exhibits an enhanced sensitivity and reduced high illumination intensity reciprocity law failure, compared to the comparative samples.

TABLE 5

| Light-sensitive material No. | Emulsion No. | Sensitivity for 1/10 sec. exposure | Sensitivity for $10^4$sec. exposure | Remarks |
|---|---|---|---|---|
| 1 | A | 100 | 70 | Comparative example |
| 2 | B | 110 | 80 | Comparative example |
| 3 | C | 150 | 150 | This invention |
| 4 | D | 140 | 140 | This invention |
| 5 | E | 180 | 170 | This invention |
| 6 | F | 130 | 130 | This invention |
| 7 | G | 120 | 120 | This invention |
| 8 | H | 180 | 175 | This invention |
| 9 | I | 120 | 60 | Comparative example |
| 10 | J | 200 | 190 | This invention |
| 11 | K | 200 | 200 | This invention |
| 12 | L | 160 | 160 | This invention |

Example 2

Using the samples prepared in Example 1, sensitometry tests were carried out in the same manner as in Example 1, except that the interval between the exposure and the processing was divided into three periods of time of 7 sec., 1 minute and 60 minutes, and that stability of a latent image was evaluated by using the density of 0.2 as an evaluation point of sensitivity.

Evaluation was conducted by the degree of deviation of a relative sensitivity which was determined at the point of density of 0.2 in the period of time ranging from 7 sec. to 60 minutes after exposure. The deviation was measured by logarithm of (the maximum exposure amount which provides the density of 0.2) divided by (the minimum exposure amount which provides the density of 0.2) in each of the samples. The results which were obtained are shown in Table 6.

From the results shown in Table 6, it is understood that the movement of sensitization or desensitization of the latent image at the initial stage after exposure is small in each of the samples of the present invention, when compared to the comparative samples.

Further, it was established by Examples 1 and 2 that each of the samples of the present invention provides a reduced fog.

TABLE 6

| Light-sensitive material No. | Emulsion No. | The degree of deviation of relative sensitivity in a short period of time after exposure (Δ logE) | Remarks |
|---|---|---|---|
| 1 | A | 0.05 | Comparative example |
| 2 | B | 0.04 | Comparative example |
| 3 | C | 0.01 | This invention |
| 4 | D | 0.00 | This invention |
| 5 | E | 0.01 | This invention |
| 6 | F | 0.00 | This invention |
| 7 | G | 0.02 | This invention |
| 8 | H | 0.01 | This invention |
| 9 | I | 0.06 | Comparative example |
| 10 | J | 0.01 | This invention |
| 11 | K | 0.01 | This invention |
| 12 | L | 0.00 | This invention |

Example 3

Preparation of Cellulose Paper Support

A pulp finished paper material composed of 50% of a bleached hard craft, 25% of a bleached hard sulfite and a bleached soft sulfite was refined by a double disc refiner followed by a Jordan conical refiner until the Canadian Standard Freeness became 200 ml to prepare a photographic paper support. To the thus-obtained pulp finished paper material, added were 0.2% of alkyl ketene dimer, 1.0% of a cationic corn starch, 0.5% of polyamidoepichlorohydrin, 0.26% of an anionic polyacrylamide, and 5.0% of $TiO_2$, on the basis of dry measure, respectively. A paper base was obtained by pressing the resulting pulp finished paper material so as to become the Sheffield interstice rate of 160 Sheffield unit and the virtual density of 0.70 g/ml.

The resulting paper base was covered on the surface thereof with a 10% hydroxyethylated corn starch solution by means of a vertical sizing press, so that 3.3 mass % of filling factor of the starch was accomplished. The thus-surface sized support was calendered until the virtual density became 1.04 g/ml to obtain a cellulose paper support. A polymer layer having the following composition was formed on the paper support and then the surface of the support on the emulsion-coating side was treated by corona discharging. Thereafter, a subbing layer was formed thereon to obtain a reflective support. Further, to the polymer layer on the emulsion-coating side, 10 mg/m$^2$ of 4,4'-bis(5-methylbenzoxazole)stilbene and a ultramarine blue were added.

Reflective Support

Emulsion-coating side Polymer composition:

Polyethylene layer containing 20 mass % of Titanium oxide (35, $\mu$m)

Backing Layer Side Polymer Composition:

Polyethylene layer (30 $\mu$m)

Photographic constituent layers of the first to seventh layers were coated in this order on the support obtained above to form a silver halide color photographic light-sensitive material samples 001A to 001L having the layer compositions mentioned below. The coating liquids used for each of the photographic constituent layers were prepared as follows:

Preparation of Coating Liquid for Fifth Layer 50 g of a cyan coupler (ExC-1), 220 g of a cyan coupler (ExC-2), 220 g of a dye image stabilizer (Cpd-1), 10 g of a dye image stabilizer (Cpd-9), 10 g of a dye image stabilizer (Cpd-10), 20 g of a dye image stabilizer (Cpd-12), 140 g of a ultraviolet ray absorbent (UV-1), 30 g of a ultraviolet ray absorbent (UV-3) and 60 g of a ultraviolet ray absorbent (UV-4) were dissolved in an mixture of 200 g of a solvent (Solv-6) and 350 ml of ethyl acetate. The resulting mixture was then emulsified and dispersed in 6500 g of a 10% aqueous gelatin solution containing 200 ml of 10% sodium dodecylbenzene sulfonate to obtain an emulsion dispersion C.

The foregoing emulsion dispersion C and an emulsion prepared in Example 1 were mixed and dissolved to prepare a coating liquid for the fifth layer so as to become the composition mentioned below. The coating amount of each emulsion is given in terms of silver.

Coating liquids for the first to forth layers and the sixth to seventh layers were also prepared in the same manner as the coating liquid for the fifth layer. As a gelatin hardener for the respective layers, 1-oxy-3,5-dichloro-s-triazine sodium salt was used.

Further, Ab-1, Ab-2, Ab-3 and Ab-4 were added to each layer in such amounts that the respective total amount becomes 15.0 mg/m$^2$, 60.0 mg/m$^2$, 5.0 mg/m$^2$ and 10.0 mg/m$^2$.

(Ab-1) Antistatic agent

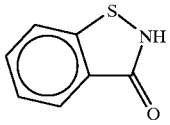

(Ab-2) Antistatic agent

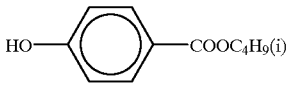

(Ab-3) Antistatic agent

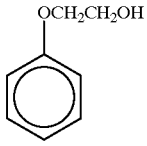

-continued (Ab-4) Antistatic agent

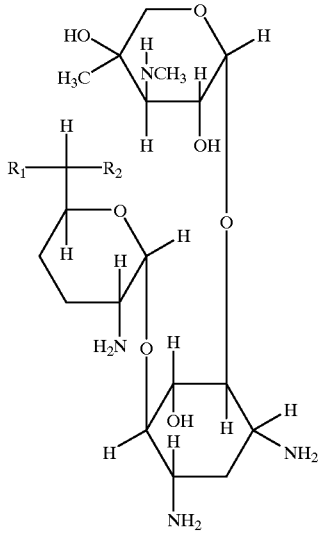

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

A mixture in 1:1:1:1 (molar ratio) of a,b,c, and d

Silver chlorobromide emulsion in each of the light-sensitive emulsion layers were prepared in the same manner as in Example 1, except that spectral sensitizing dyes as shown below were used in place of those of Example 1. Blue-sensitive emulsion layer:

(Sensitizing dye A)

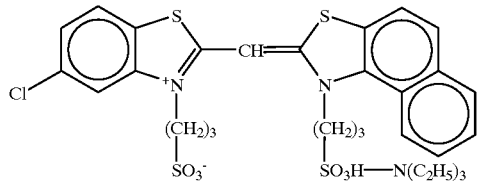

(Sensitizing dye B)

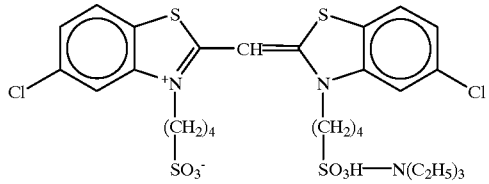

(Sensitizing dye C)

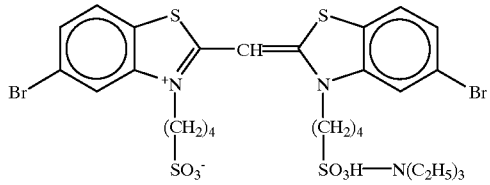

($1.55\times10^{-4}$ mole of Sensitizing dye A, B, and C, per mole of silver halide, respectively, was added thereto.) Green-sensitive emulsion layer:

(Sensitizing dye D)

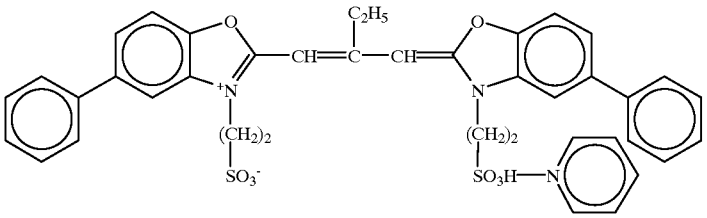

(Sensitizing dye E)

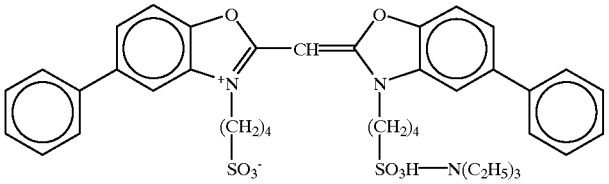

(Sensitizing dye F)

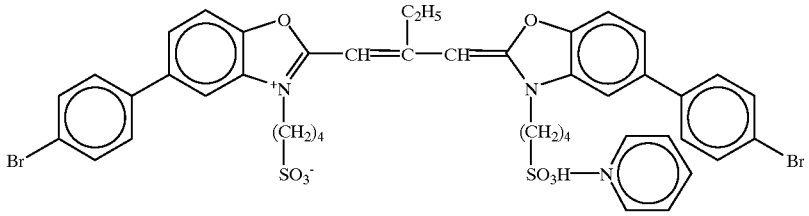

($3.3\times10^{-4}$ mole of Sensitizing dye D, $5.5\times10^{-5}$ mole of Sensitizing dye E and $2.4\times10^{-4}$ mole of Sensitizing dye F, per mole of silver halide, respectively)

Red-sensitive Emulsion Layer

The emulsion prepared in Example 1 was used.

Further, 1-(3-methylureidophenyl)-5-mercaptotetrazole was added to the blue-sensitive emulsion layer, the green-sensitive emulsion layer and the red-sensitive emulsion layer in amounts of $3.3\times10^{-4}$ mole, $1.0\times10^{-3}$ mole and $5.9\times10^{-4}$ mole, per mole of silver halide, respectively.

Further, the above-mentioned compound was also added to the second, forth, sixth and seventh layers in such amounts that the coating amount becomes 0.2 mg/m$^2$, 0.2 mg/m$^2$, 0.6 mg/m$^2$ and 0.1 mg/m$^2$, respectively.

Further, 4-hydroxy-6-methyl-1,3,3a,7-tetrazaindene was added to the blue-sensitive emulsion layer and the green-sensitive emulsion layer in amounts of $1\times10^{-4}$ mole and $2\times10^{-4}$ mole, per mole of silver halide, respectively.

Further, a copolymer of methacrylic acid and butyl acrylate (mass ratio 1:1, average molecular weight 200000 to 400000) was added to the red-sensitive emulsion layer in amounts of 0.05 g/m$^2$.

Disodium catechol-3,5-disulfonate was added to the second, forth and sixth layer in amounts of 6 mg/m$^2$, 6 mg/m$^2$ and 18 mg/m$^2$, respectively.

Further, the dyes shown below (figures in parentheses represent coating amounts) were added to the emulsion layers for prevention of irradiation.

(2mg/m$^2$)

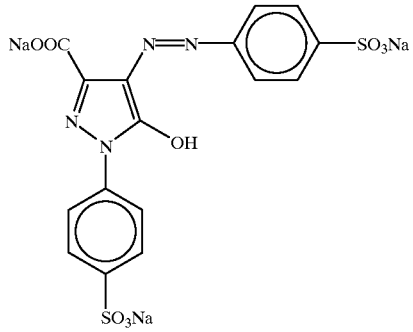

(5mg/m$^2$)

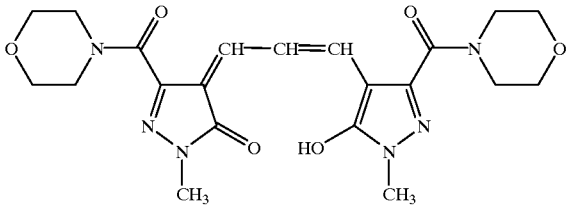

(1mg/m$^2$)

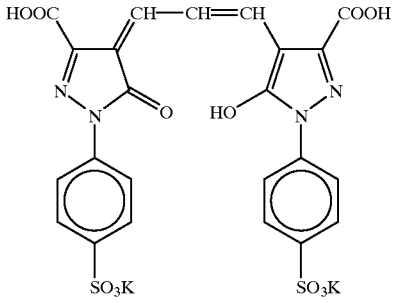

-continued (10mg/m$^2$)

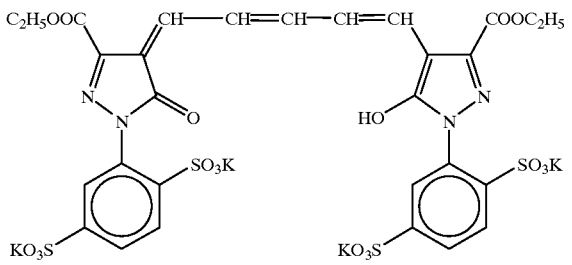

(10mg/m$^2$)

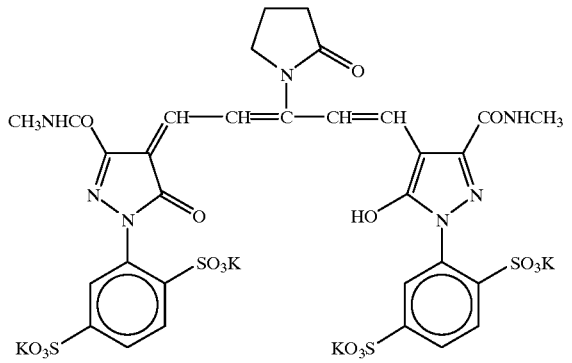

(Layer Constitution)

The composition of each layer is shown below. The numbers show coating amounts (g/m$^2$). In the case of the silver halide emulsion, the coating amount is in terms of silver.

First Layer (Blue-sensitive emulsion layer)

| | |
|---|---|
| Emulsion | 0.25 |
| Gelatin | 1.35 |
| Yellow coupler (ExY-1) | 0.41 |
| Yellow coupler (ExY-2) | 0.21 |
| Color-image stabilizer (Cpd-1) | 0.08 |
| Color-image stabilizer (Cpd-2) | 0.04 |
| Color-image stabilizer (Cpd-3) | 0.08 |
| Color-image stabilizer (Cpd-8) | 0.04 |
| Solvent (Solv-1) | 0.23 |

Second Layer (Color-mixing Inhibiting Layer)

| | |
|---|---|
| Gelatin | 1.00 |
| Color-mixing inhibitor (Cpd-4) | 0.05 |
| Color-mixing inhibitor (Cpd-5) | 0.07 |
| Color-image stabilizer (Cpd-6) | 0.007 |
| Color-image stabilizer (Cpd-7) | 0.14 |
| Color-image stabilizer (Cpd-13) | 0.006 |
| Solvent (Solv-1) | 0.06 |
| Solvent (Solv-2) | 0.22 |

Third Layer (Green-Sensitive Emulsion Layer)

| | |
|---|---|
| Emulsion | 0.12 |
| Gelatin | 1.20 |
| Magenta coupler (ExM-1) | 0.10 |
| Magenta coupler (ExM-2) | 0.05 |

-continued

| | |
|---|---|
| Ultraviolet absorbing agent (UV-1) | 0.05 |
| Ultraviolet absorbing agent (UV-2) | 0.02 |
| Ultraviolet absorbing agent (UV-3) | 0.02 |
| Ultraviolet absorbing agent (UV-4) | 0.03 |
| Color-image stabilizer (Cpd-2) | 0.01 |
| Cplor-image stabilizer (Cpd-4) | 0.002 |
| Color-image stabilizer (Cpd-7) | 0.08 |
| Color-image stabilizer (Cpd-8) | 0.01 |
| Color-image stabilizer (Cpd-9) | 0.03 |
| Color-image stabilizer (Cpd-10) | 0.01 |
| Color-image stabilizer (Cpd-11) | 0.0001 |
| Color-image stabilizer (Cpd-13) | 0.004 |
| Solvent (Solv-3) | 0.10 |
| Solvent (Solv-4) | 0.19 |
| Solvent (Solv-5) | 0.17 |

Fourth Layer (Color-Mixing Inhibiting Layer)

| | |
|---|---|
| Gelatin | 0.71 |
| Color-mixing inhibitor (Cpd-4) | 0.04 |
| Color-mixing inhibitor (Cpd-5) | 0.05 |
| Color-image stabilizer (Cpd-6) | 0.005 |
| Color-image stabilizer (Cpd-7) | 0.10 |
| Color-image stabilizer (Cpd-13) | 0.004 |
| Solvent (Solv-1) | 0.04 |
| Solvent (Solv-2) | 0.16 |

Fifth Layer (Red-Sensitive Emulsion Layer)

| | |
|---|---|
| Emulsion | 0.17 |
| Gelatin | 0.98 |
| Cyan coupler (ExC-1) | 0.05 |
| Cyan coupier (ExC-2) | 0.22 |
| Ultraviolet absorbing agent (UV-1) | 0.14 |
| Ultraviolet absorbing agent (UV-3) | 0.03 |
| Ultraviolet absorbing agent (UV-4) | 0.06 |
| Color-image stabilizer (Cpd-1) | 0.22 |
| Color-image stabilizer (Cpd-9) | 0.01 |
| Color-image stabilizer (Cpd-10) | 0.01 |
| Color-image stabilizer (Cpd-12) | 0.02 |
| Solvent (Solv-6) | 0.20 |

Sixth Layer (Ultraviolet Absorbing Layer)

| | |
|---|---|
| Gelatin | 0.46 |
| Ultraviolet absorbing agent (UV-1) | 0.14 |
| Ultraviolet absorbing aqent (UV-2) | 0.05 |
| Ultraviolet absorbing agent (UV-3) | 0.05 |
| Ultraviolet absorbing agent (UV-4) | 0.04 |
| Ultraviolet absorbing agent (UV-5) | 0.03 |
| Ultraviolet absorbing agent (UV-6) | 0.04 |
| Solvent (Solv-7) | 0.18 |

| Seventh Layer (Protective Layer) | |
|---|---|
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-1) Yellow coupler
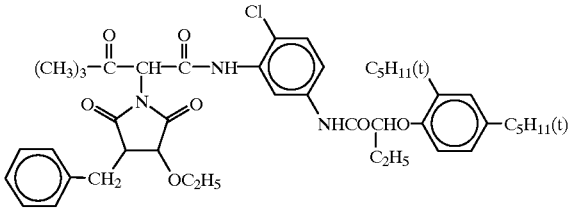
(ExY-2) Yellow coupler
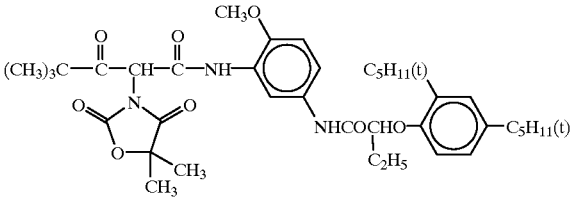
(ExM-1) Magenta coupler
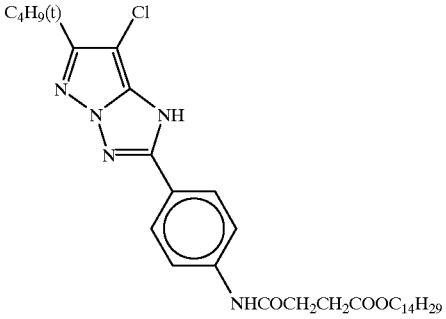
(ExM-2) Magenta coupler
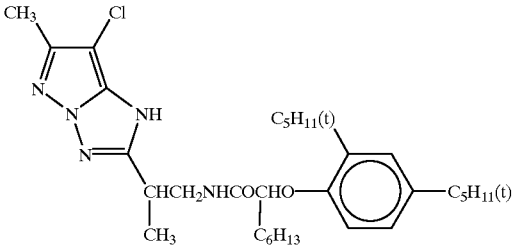
(ExC-1) Cyan coupler
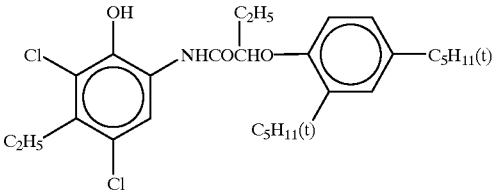
(ExC-2) Cyan coupler
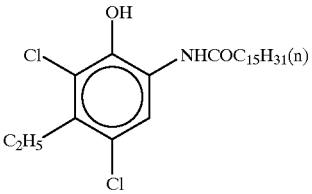
-continued
(ExC-3) Cyan coupler
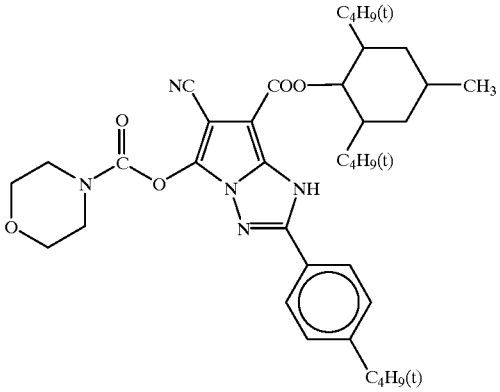
(ExC-4) Cyan coupler
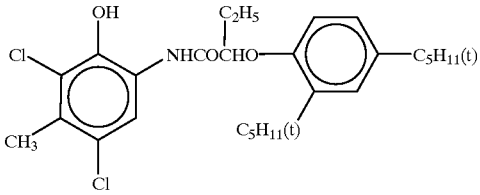
(Cpd-1) Color-image stabilizer
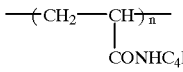
number-average molecular weight 60,000
(Cpd-2) Color-image stabilizer
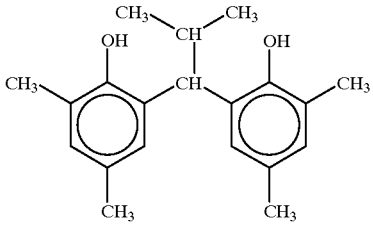
(Cpd-3) Color-image stabilizer
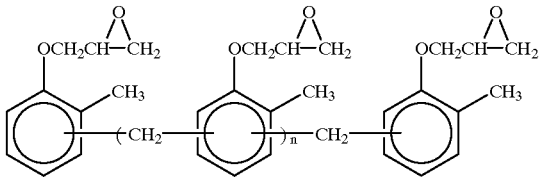
n = 7~8 (average value)
(Cpd-4) Color-mixing inhibitor
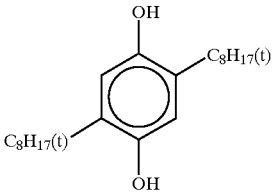

-continued
(Cpd-5) Color-mixing inhibitor
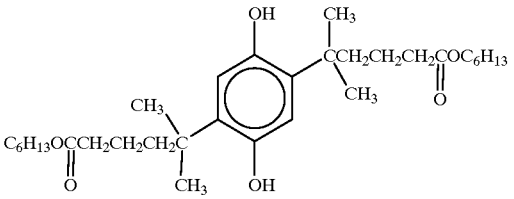
(Cpd-6) Auxiliary agent of color-mixing prevention
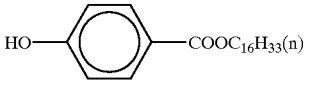
(Cpd-7) Stabilizer
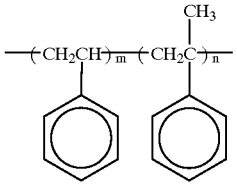
Number-average molecular weight 600
m/n = 10/90
(Cpd-8) Color-image stabilizer
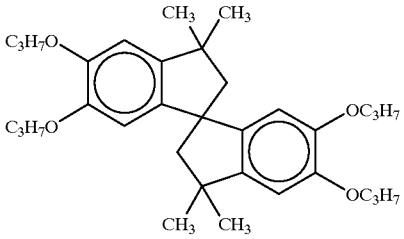
(Cpd-9) Color-image stabilizer
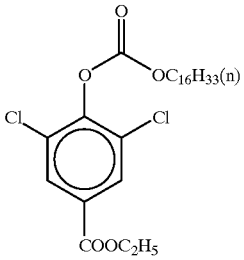
(Cpd-10) Color-image stabilizer
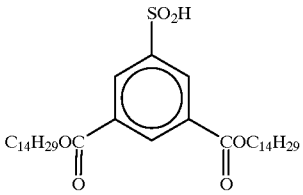
-continued
(Cpd-11)
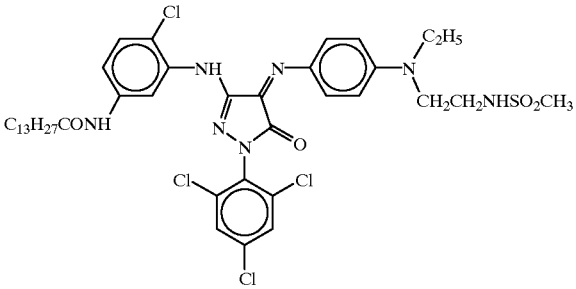
(Cpd-12) Color-image stabilizer
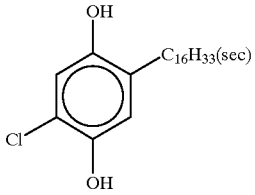
(Cpd-13) Color-image stabilizer
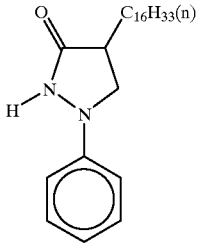
(Cpd-14) Surfactant
A mixture in 7:3 (mass ratio) of
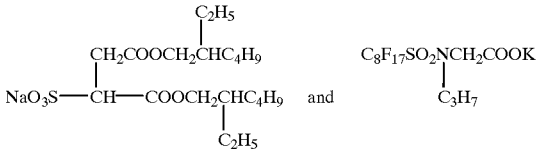
(Cpd-15) Surfactant
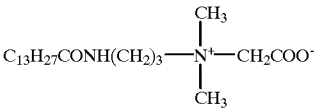
(Cpd-16)
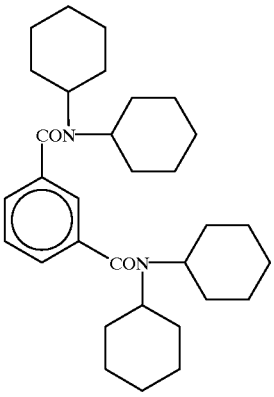

-continued
(Cpd-17)
A mixture in 1:1 of
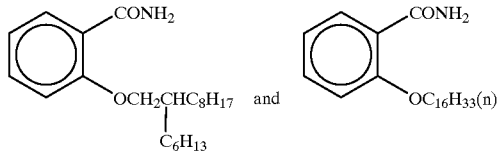
(Cpd-18)
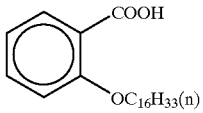
(Cpd-19)
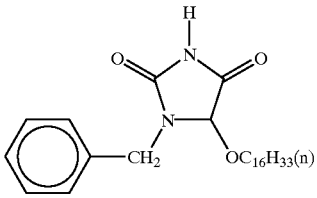
(Cpd-20)
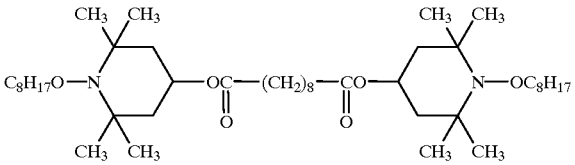
(Cpd-21) Color-image stabilizer
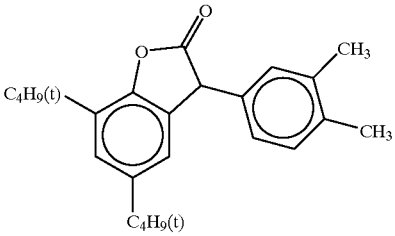
(UV-1) Ultraviolet absorbing agent
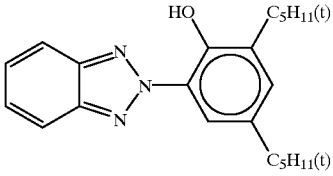
(UV-2) Ultraviolet absorbing agent
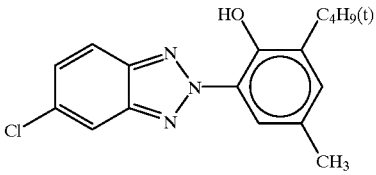
-continued
(UV-3) Ultraviolet absorbing agent
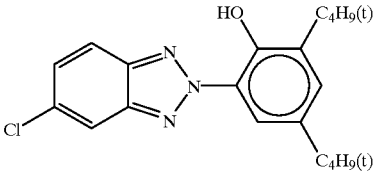
(UV-4) Ultraviolet absorbing agent
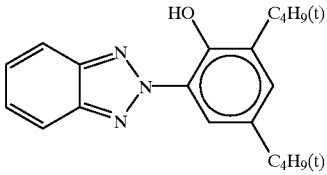
(UV-5) Ultraviolet absorbing agent
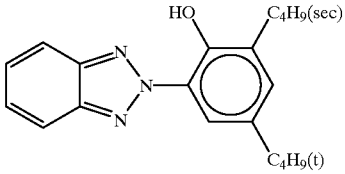
(UV-6) Ultraviolet absorbing agent
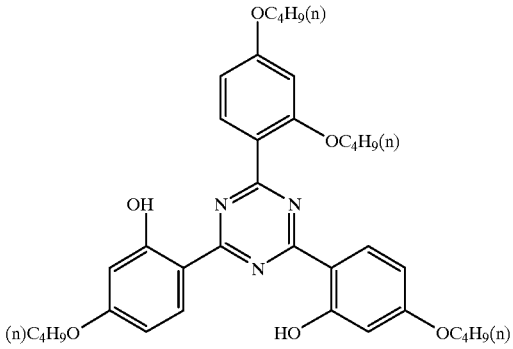
(Solv-1)
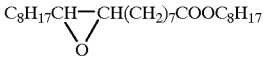
(Solv-2)
A mixture in 1:1 (mass ratio) of
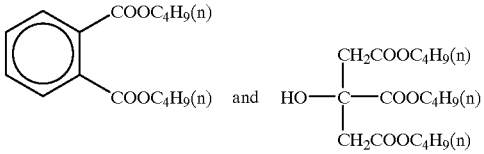
(Solv-3)
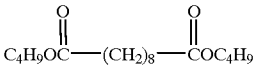
(Solv-4)
(Solv-5)
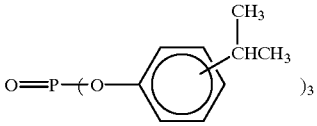

-continued (Solv-6)

A mixture in 1:1 (mass ratio) of

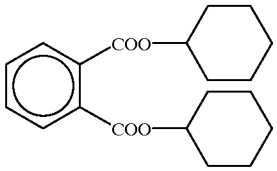

and

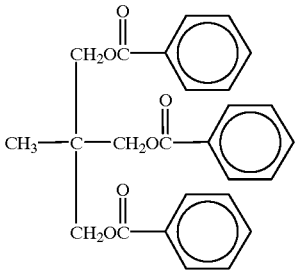

(Solv-7)

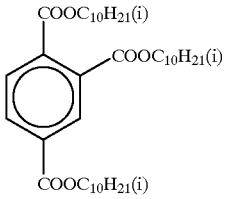

Further, silver halide color photographic light-sensitive material samples 101A to 101L were prepared in the same manner as the thus-prepared samples 001A to 001L, except that the composition of the fifth layer was changed as described below.

Fifth Layer (Red-Sensitive Emulsion Layer)

| | |
|---|---|
| Emulsion | 0.11 |
| Gelatin | 1.13 |
| Cyan coupler (ExC-2) | 0.05 |
| Cyan coupler (ExC-3) | 0.10 |
| Cyan coupler (ExC-4) | 0.01 |
| Color-image stabilizer (Cpd-7) | 0.06 |
| Color-image stabilizer (Cpd-9) | 0.04 |
| Color-image stabilizer (Cpd-13) | 0.01 |
| Color-image stabilizer (Cpd-16) | 0.01 |
| Color-image stabilizer (Cpd-17) | 0.12 |
| Color-image stabilizer (Cpd-18) | 0.04 |
| Color-image stabilizer (Cpd-19) | 0.07 |
| Color-image stabilizer (Cpd-20) | 0.07 |
| Solvent (Solv-5) | 0.14 |

Further, silver halide color photographic light-sensitive material samples 201A to 201L were prepared in the same manner as the thus-prepared samples 001A to 001L, except that the composition of the fifth layer was changed as described below.

Fifth Layer (Red-Sensitive Emulsion Layer)

| | |
|---|---|
| Emulsion | 0.16 |
| Gelatin | 1.00 |
| Cyan coupler (ExC-1) | 0.05 |
| Cyan coupler (ExC-2) | 0.18 |
| Cyan coupler (ExC-3) | 0.024 |
| Ultraviolet absorbing agent | 0.04 |

-continued

| | |
|---|---|
| (UV-1) | |
| Ultraviolet absorbing agent | 0.01 |
| (UV-3) | |
| Ultraviolet absorbing agent | 0.01 |
| (UV-4) | |
| Color-image stabilizer (Cpd-1) | 0.23 |
| Color-image stabilizer (Cpd-9) | 0.01 |
| Color-image stabilizer (Cpd-12) | 0.01 |
| Color-image stabilizer (Cpd-13) | 0.01 |
| Solvent (Solv-6) | 0.23 |

Samples 001A to 001L, 101A to 101L and 201A to 201L each prepared as described above, after these samples being completed to store for a day in the condition of 25° C.-55%RH, were subjected to the same sensitometry test as in Example 1 through three color separation filters. Further, they were subjected to the same sensitometry test as in Example 2, in which the interval after exposure was changed. A processing was carried out according to the processing steps as described below. The logarithm (log E) of the exposure amount required to provide a density of 0.5 was measured and calculated.

The processing steps mentioned below are the same as in Example 1 except for the following. Each of the above-mentioned light-sensitive materials was cut into a roll having a width of 127 mm. The resulting rolls were image-wise exposed by means of a minilab printer processor PP1258AR manufactured by Fuji Photo Film Co., Ltd., and then processed continuously (running processing) according to the processing steps mentioned below, until the amount of the replenisher to the color developer tank became two times the capacity of the color developer tank. A processing was carried out using the resulting running solution.

Processing B

The foregoing light-sensitive material 201A was cut into a roll having a width of 127 mm. The resulting roll was image-wise exposed in the same manner as in the above-mentioned example and then processed continuously (running processing) according to the processing steps mentioned below, until the amount of the replenisher to the color developer tank became two times the capacity of the color developer tank. The processing in which the resulting running solution was used, was designated as "processing B". In the processing, a minilab printer processor PP1258AR manufactured by Fuji Photo Film Co., Ltd., which was remodeled so that a conveying speed could be increased to shorten a processing (step) time, was used.

| Processing Step | Temperature | Time | Amount *of replenishment |
|---|---|---|---|
| Color Development | 45.0° C. | 15 sec. | 45 ml |
| Bleach / fixing | 40.0° C. | 15 sec. | 35 ml |
| Rinsing (1) | 40.0° C. | 7 sec. | — |
| Rinsing (2) | 40.0° C. | 7 sec. | — |

-continued

| Processing Step | Temperature | Time | Amount *of replenishment |
|---|---|---|---|
| Rinsing (3)** | 40.0° C. | 7 sec. | — |
| Rinsing (4)** | 40.0° C. | 7 sec. | 121 ml |

*The amount of replenishment is per $m^2$ of light-sensitive material.
**A Rinse (3) is equipped with a rinse cleaning system RC50D manufactured by Fuji Photo Film Co., Ltd., and then a rinse solution is taken out from the Rinse (3) and sent to a reverse osmotic film module (RC50D) by means of a pump. A transmitted water obtained in the tub is supplied to a Rinse (4) and a concentrated water is returned to the Rinse (3). A pump pressure was adjusted so that an amount of the transmitted water to the reverse osmotic film module could be maintained at the rate of 50 to 300 ml per minute. A thermo-regulated circulation was carried out for 10 hours a day. Rinsing was performed by tank counterflow from (1) to (4).

The compositions of each of the processing solutions were as follows:

The compositions of each of the processing solutions were as follows:

| | Tank solution | Replenishing solution |
|---|---|---|
| [Color developing solution] | | |
| Water | 800 ml | 800 ml |
| Dimethylpolysiloxane-based surfactant (Silicone KF351A manufactured by Shinetzu Chemical Co., Ltd. | 0.1 g | 0.1 g |
| Tri (isopropanol)amine | 8.8 g | 8.8 g |
| Ethylenediamine tetraacetic acid | 4.0 g | 4.0 g |
| Polyethyleneglycol (Molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightening agent (HackolFWA-SF manufactured by Showa Chemical Co., Ltd.) | 2.5 g | 5.0 g |
| Sodium sulfite | 0.1 g | 0.1 g |
| Disodium N,N-bis (sulfonatoethyl) hydroxylamine | 8.5 g | 11.1 g |
| N-ethyl-N-(β-methanesulfonamideethyl) -3-methyl-4-amino-4-aminoaniline.3/2 sulfuric acid.1 $H_2O$ | 10.0 g | 22.0 g |
| Potassium carbonate | 26.3 g | 26.3 g |
| Water to make | 1000 ml | 1000 ml |
| pH (at 25° C., adjusted with potassium hydroxide and sulfuric acid) | 10.15 | 12.50 |
| [Bleach / fixing solution] | | |
| Water | 700 ml | 600 ml |
| Ammonium ethylenediamine tetraacetato ferrite (III) | 75.0 g | 150.0 g |
| Ethylenediaminetetraacetic acid | 1.4 g | 2.8 g |
| m-carboxy benzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium hydrogen sulfite | 23.1 g | 46.2 g |
| Water to make | 1000 ml | 1000 ml |
| pH (at 25° C., adjusted with acetic acid and aqueous ammonia) | 5.5 | 5.5 |
| [Rinsing solution] | | |
| Chlorinated sodium isocyanulate | 0.02 g | 0.02 g |
| Deionized water | 1000 ml | 1000 ml |
| (conductivity: 5 μS/cm or less) | | |
| pH | 5.5 | 5.5 |

The results of the foregoing tests established that the samples of the present invention showed such excellent properties that they exhibited higher sensitivity, and reduced both high illumination intensity reciprocity law failure and regression of latent image in the initial stage after exposure, compared to samples using comparative emulsions. Further, the samples of the present invention provided low fogging.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide emulsion comprising gold-sensitized silver halide grains having a silver chloride content of 95 mole % or more, wherein from 8% to 50% of the amount of gold existing on the part of the silver halide grains is in the state of metal gold.

2. The silver halide emulsion as claimed in claim 1, wherein the amount of gold existing on the part of the silver halide grains in the emulsion is in the range of 40% to 80%, based on the total amount of gold in the emulsion.

3. The silver halide emulsion as claimed in claim 1, wherein the total amount of gold in the emulsion is in the range of $0.05A\times10^{-4}$ mole to $1.2A\times10^{-4}$ mole per mole of silver halide, assuming that A (μm) is the side length of a cube whose volume is equal to the volume of the silver halide grain.

4. The silver halide emulsion as claimed in claim 1, wherein the ripening temperature of chemical sensitization according to the gold sensitization is carried out at 72° C. or more.

5. The silver halide emulsion as claimed in claim 1, comprising at least one complex of a metal of Group VIII of periodic table.

6. The silver halide emulsion as claimed in claim 1, wherein the silver halide emulsion is sensitized by a sulfur sensitizer in addition to the gold sensitization.

7. The silver halide emulsion as claimed in claim 1, which comprises at least one of mercaptotetrazoles.

8. A silver halide color photographic light-sensitive material having a support and having thereon at least one silver halide emulsion layer which comprises a silver halide emulsion comprising gold-sensitized silver halide grains having a silver chloride content of 95 mole % or more, wherein from 8% to 50% of the amount of gold existing on the part of the silver halide grains is in the state of metal gold.

9. The silver halide color photographic light-sensitive material as claimed in claim 8, wherein the amount of gold existing on the part of the silver halide grains in the emulsion is in the range of 40% to 80%, based on the total amount of gold in the emulsion.

10. The silver halide color photographic light-sensitive material as claimed in claim 8, wherein the total amount of gold in the emulsion is in the range of $0.05A\times10^{-4}$ mole to $1.2A\times10^{-4}$ mole per mole of silver halide, assuming that A (μm) is the side length of a cube whose volume is equal to the volume of the silver halide grain.

11. The silver halide color photographic light-sensitive material as claimed in claim 8, wherein the ripening temperature of chemical sensitization according to the gold sensitization is carried out at 72° C. or more.

12. The silver halide color photographic light-sensitive material as claimed in claim 8, wherein the silver halide emulsion comprises at least one complex of a metal of Group VIII of periodic table.

13. The silver halide color photographic light-sensitive material as claimed in claim 8, wherein the silver halide emulsion is sensitized by a sulfur sensitizer in addition to the gold sensitization.

14. The silver halide color photographic light-sensitive material as claimed in claim 8, wherein the silver halide emulsion comprises at least one of mercaptotetrazoles.

15. The silver halide color photographic light-sensitive material as claimed in claim 8, wherein the support is a reflective support.

* * * * *